United States Patent [19]

Rochefort

[11] Patent Number: 4,913,433

[45] Date of Patent: Apr. 3, 1990

[54] PROTECTIVE LINING FOR BOWLING ALLEY

[75] Inventor: Lucien Rochefort, Beauport, Canada

[73] Assignee: Mendes Inc., Caron, Canada

[21] Appl. No.: 306,408

[22] Filed: Feb. 6, 1989

[51] Int. Cl.[4] ..... A63D 1/00

[52] U.S. Cl. ..... 273/51; 52/57

[58] Field of Search ..... 273/51; 52/57; 193/2 R

[56] References Cited

U.S. PATENT DOCUMENTS

| | | | |
|---|---|---|---|
| 2,301,776 | 11/1942 | Gremp et al. | 273/51 |
| 2,301,777 | 11/1942 | Gremp et al. | 273/51 |
| 2,971,759 | 2/1961 | Blatt | 273/51 |
| 3,186,712 | 6/1965 | Kessler | 273/51 |
| 3,223,415 | 12/1965 | Stengel et al. | 273/51 |
| 4,532,739 | 8/1985 | Cooper | 52/57 |
| 4,796,887 | 1/1989 | Sternhagen | 273/51 |
| 4,801,143 | 1/1989 | Heddon | 273/51 |

*Primary Examiner*—Anton O. Oechsle

*Attorney, Agent, or Firm*—Pierre Lespérance

[57] ABSTRACT

A bowling alley having at least one elongated bowling ball runway, at least one downwardly offset concave gutter sidewisely depending from the runway, and at least one upwardly offset partition bar sidewisely depending from the opposite side edge of the gutter. A first wear-resistant semi-rigid protecting capping removably covers the upper portion of the partition bar. A second wear-resistant flexible protecting lining removably covers the top face of the gutter. Each of the capping and lining further has lengthwise ridges, whereby should the bowling ball engage the gutter or the bar, the ridges will bias the bowling ball travel in a path parallel to the elongated runway while prolonging the useful lifetime of the bowling alley. The cappings and linings also decrease the noise produced by the bowling balls.

9 Claims, 1 Drawing Sheet

PROTECTIVE LINING FOR BOWLING ALLEY

FIELD OF THE INVENTION

This invention relates to bowling alley construction.

BACKGROUND OF THE INVENTION

In the bowling game, the goal is for the player to throw the sperical bowling ball on the bowling alley runway, toward the bowling alley pit end, so as to aim to strike the set of upstanding skittles or ninepins to make them fall. As such, the runway is usually of very strong construction, and thus very long lasting. However, novice players are susceptible of throwing the ball in a wrong direction, which is to say, the ball will not roll longitudinally of the runway but transversely thereof toward the sidewise gutters and possibly beyond, toward the partition bar separating two gutters from two adjacent bowling alleys. These gutters and partition bars do tend to become worn out quite easily, because of their relative poor construction, when several novice players put a strain on the equipment.

Hence, bowling alley operations have a bowling alley construction being of unequal visual appeal, which is not good for business.

Effective protective coverings do exist in the art, however, they are usually destined for specially constructed gutters and partition bars, and do not fit ordinary ones from conventional bowling alleys.

OBJECTS OF THE INVENTION

The main object of the invention is to increase the durability of bowling alley constructions.

An important object of the invention is to provide a bowling alley construction which will have easily removable protective coverings for the gutter and inter-gutter partition bars.

A further object of the invention is that the above-mentioned protective coverings be easy to install/dismantle and of low manufacturing cost.

An object of the invention is to provide protective coverings which will reduce the noise made by the bowling balls and will fit and adapt to any standard gutter and partition bar from a conventional bowling alley.

SUMMARY OF THE INVENTION

In accordance with the objects of the invention, there is disclosed, for use in a bowling alley having at least one elongated bowling ball runway, at least one downwardly offset concave gutter sidewisely depending from said runway, and at least one upwardly offset partition bar sidewisely depending from the opposite side edge of said gutter, a first wear-resistant semi-rigid protecting member for removably covering the upper portion of said partition bar, and a second wear-resistant flexible protecting member for removably covering the top face of said gutter; wherein each of said first and second protecting members further have guide means whereby should the ball engage said gutter or said bar, said guide means will bias the bowling ball travel in a path parallel to said elongated runway, said guide means furthermore prolonging the useful lifetime of said bowling alley.

Preferably, each said protecting members includes main, substantially flat and horizontal portions, and wherein said guide means is a number of lengthwise parallel ridges, integrally mounted to top surface of said flat portions.

Advantageously, said partition bar includes a base elongated wooden stud over which is mounted a plank, said first protecting member surrounding the whole of said plank and anchored by anchoring means to said plank and also to said wooden stud. It would then be desirable that said first protecting member define a hollow elongated member of D-shape in cross-section, with said anchoring means being a number of screws extending through said D-shaped member, through said plank and through said wooden stud.

Profitably, said first and second protecting members are made of a semi-rigid, wear-resistant plastic material such as polyethylene.

Preferably, said second protecting member is a single elongated sheet of flexible, wear-resistant plastic material, applied flatly against said concave gutter the latter consisting of plywood board, and anchored thereto. Moreover, a retaining strip could advantageously be provided, consisting of a small, flexible, wear-resistant plastic plate having a 180° curved enlarged flange, said plate and flange edgewisely engaging under and over said protecting gutter sheet respectively on the side of said runway exclusively of the opposite side thereof, and nailing driven through said plastic plate and into the gutter.

Preferably, said partition bar defines a number of base wooden studs over which is placed a large, flattened pyramidal-shaped, elongated, wooden plank, said first protecting member defining; a slightly bent, H-shaped, semi-rigid plastic module, applied against and conforming to the shape of the top apex area of said pyramidal plank, said H-shaped module defining two opposite channels between the legs of its H, and two substantially flat sheets of semi-rigid plastic material, each one of said sheet having an inner offset edgewise section, for engagement into a corresponding one of said channels of the H-shaped module, and an outer transverse edgewise flange making a small obtuse angle with the corresponding said flat sheet of the protecting member so as to follow the contour of said pyramidal plank, each said flange having a right-angle inturned lip extending between the edgewise section of said pyramidal plank and the outermost base wooden stud; further including a number of screws, vertically driven through said sheets, said pyramidal plank, and said outermot studs, wherein said sheets are frictionally releasably edgewisely interlocked through said H-shaped module.

The invention also consists of the combination of the bowling alley and the protective coverings.

BRIEF DESCRIPTION OF THE DRAWINGS

FIGS. 4–8 are enlarged partly broken perspective views of the various protection modules for the bowling alley.

DETAILED DESCRIPTION OF THE INVENTION

Figures 1, 1A, 2, 3:
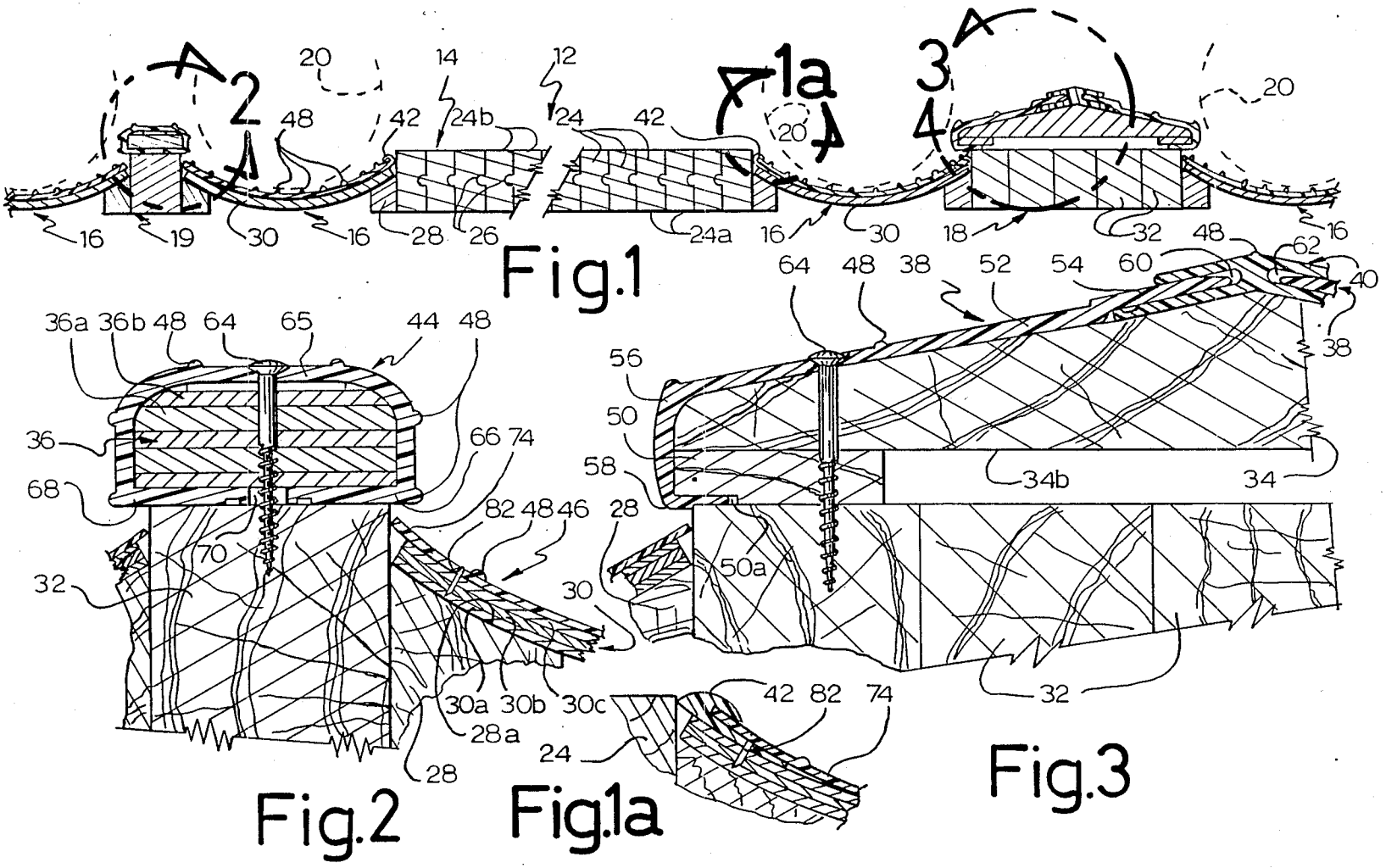
FIG. 1 is a vertical cross-sectional view of a multiple bowling alley assembly, protected with surface modules in accordance with the teachings of the invention.
FIGS. 1*a*, 2 and 3 are enlarged views of the areas circumscribed within circles 1*a*, 2 and 3 respectively of FIG. 1.

The bowling alley 12 consists of elongated parallel runways 14 (only one being shown in the drawings), spaced by gutters 16 and often also by partition bars 18 or 19. Each spherical ball 20 is thrown by a player at the upstream end of one runway 14, with a mainly horizontal vector component so that the ball will fall on the runway by gravity and will roll along the runway toward the set of upright skittles (not shown) standing on the runway near the end pit of the runway. A novice player may not strike any skittle at all, wherein the ball 20 unfortunately diverges from the longitudinal axis of the bowling alley runway 14 and eventually engages into the gutter 16, and even may strike the partition bars between the gutters.

When a ball reaches the end pit, a known ball return system will then induce the ball 20 to return to the player, via a ball return track (not shown), up to the delivery end (not shown) of the bowling alley where the ball is again available to a player.

Each runway 14 is made from a plurality of studs 24, e.g. 2"×4" studs with their large sides abutting against each other in a common plane, wherein they are supported over ground by their small siides 24*a* while their opposite small sides 24*b* constitute the ball engaging surface of runway 14. Tenon and mortise joints 26 enable each adjacent pair of studs 24, 24, to be frictionally locked in a common plane. And the studs 24 are all glued to each other in known fashion. Studs 24 are made of hard wood.

To each of the two opposite free end studs 24 is connected a smaller stud 28 having a downwardly outwardly inclined bevelled top end 28*a*. Each pair of registering half-studs 28 will edgewisely support the gutter 16, which consists of an elongated plywood board assembly 30 having a concave curvature (from the player's point of view). As suggested in FIG. 2, the plywood board assembly 30 may consist of a few lamination boards 30*a*, 30*b*, 30*c*, . . . applied and glued each against the other, whereas the surface 24*b* of bowling alley runway 14 is flat with perhaps a slight slope toward the end pit. The surface of gutter 30 is concavely curved and is below the plane of surface 24*b*. Partitions 18 or 19 are preferably interposed between the two gutters 16 of two adjacent runways 14, to prevent the balls 20 from undesirably going or "jumping" from one runway 14 to another. Therefore, the top end of partitions 18, 19 is higher than the top surface 24*b* of runway 14. Partitions 18, 19 are also sidewisely flanked by bevelled half studs 28, for edgewisely supporting one edge section of the corresponding gutter. Partitions 18, 19 are usually made of large wooden studs 32, 34, and studs 32 and plywood board 36, respectively, board 36 being made of a number of superimposed laminations 36*a*, 36*b*, . . . up to a desired height.

In accordance with the invention, the gutter plywood 30 and the top walls 34, 36 of partition bars 18, 19 are covered by a protective lining or sheet of semi-rigid but wear-resistant plastic material, premolded to various shapes in modules 38, 40, 42, 44, 46 as illustrated in FIGS, 4–8. Each module 40, 42 is characterized in that it has one elongated ridge 48, and each module 44, 46 has a plurality of elongated ridges 48 that are upwardly projecting and that extend longitudinally parallel to the bowling alley runway. Ridges 48 are convex in cross-sectional view and full, as illustrated in FIG. 2. Two modules 38, and one module 40 are designed to be interconnected in triplet to cover the top section 34 of larger partition 18; module 44 is designed to be mounted to cover the top section 36 of smaller partition 19; module 46 is applied flatly against plywood 30 to cover a gutter 16; and module 42 is edgewisely applied to the edge section of module 46 proximate runway 12, exclusive of the opposite edge section thereof, to be taken in sandwich between module 46 and plywood board 30. More particularly, the upper wooden stud member 34 of partition 18 is of flattened pyramidal shape, defining a central uppermost apex 34*a* and a flat horizontal bottom face 34*b*, the latter being spaced from lower stud members 32 by two opposite side planks 50. Each plank 50 includes a flat groove 50*a* on the exterior side of its bottom faces. Module 38 includes a main panel 52, defining an offset inner edge section 54 and a transverse outer edge flange 56 making an obtuse angle with panel 52, an inturned lip 58 projecting at right angle from the outer edge of flange 56. Thus, each module 38 covers one half of pyramid stud 34, with each lip 58 extending into a corresponding groove 54*a*.

Module 40 is H-shaped, being slightly bent at its centre for conforming to the shape of apex section 34*a*, wherein the two channels 60, 62 defined by the H of the module 40 are slidingly engaged by offset legs 54. Large screws 64 are thereafter screwed through panel 52, stud 34, plank 50 and one side stud 32 of each module 40, whereby lip 58 be frictionally locked in position between plank 50 and stud 32 and whereby both registering modules 38, 38, be frictionally locked in position edgewisely at the level of H-shape module 40.

Module 44 is well shown in FIGS. 2 and 7 and defines a main body 65 making a C in cross-section, with two converging end lips 66, 68 extending short of each other, wherein a lengthwise space 70 is defined between lips 66, 68. Module 44 is flexible enough to be opened and made to receive into its channel 72 the top wall 36 and thereafter large scres 64 are screwed through body 65, top wall 36 through space 70 and into the lower stud 32 of partition 19 wherein the whole partition 19 is steadfast.

Module 46 is a simple sheet 74 of semi-rigid plastic material with a plurality of lengthwise spaced ridges 48. Ridges 48 have two purposes: they increase the useful lifetime of module 46 (and to a lesser extent that of the other modules 38–44) by reducing wear from the ball not coming in direct contact with sheet 74; and they prevent lateral or sideways skidding of the ball by promoting the displacement thereof parallel to the longitudinal axis of the bowling alley 12 i.e. lengthwisely along ridges 48.

Module 42 is a clamping strip for sheet 74 and defines a small plastic plate 76 edgewisely provided with a 180° curved flange 78 defining a deep cavity 80 for frictional engagement by the edge section of panel 74. Nails 82 anchor plate 76 to plywood board 30 under sheet 74. Sheet 74 is preferably extruded in transversely flat condition so that the full length necessary for a gutter can be rolled up in a compact roll for ease of transport. To install the same, one edge is inserted into the already nailed clamping strip 74, then its free edge is forced into contact with stud 32 which will impart a curved cross-section to the sheet 74. The latter remains locked in its installed position.

It is readily understood that the modules 38–46 are easily removable, and replaceable when worn out. They are preferably made of polyethylene.

I claim:

1. For use in a conventional make bowling alley having at least one elongated runway, at least one downwardly offset concave gutter sidewisely depending from said runway, and at least one upwardly offset partition bar sidewisely depending from the side edge of said gutter opposite said runway, a first wear-resistant semi-rigid protecting member for removably covering the upper portion of said partition bar, and a second wear-resistant flexible protecting member for removably covering the top face of said gutter; wherein each of said first and second protecting members further have guide means whereby should the ball inadvertently engage said gutter or said bar, said guide means will bias the bowling ball to travel in a path parallel to said elongated runway, said guide means furthermore prolonging the useful lifetime of said bowling alley.

2. A system of protective coverings as defined in claim 1, wherein each said protecting members includes main, substantially flat and horizontal portions, and wherein said guide means is a number of lengthwise parallel ridges, integrally mounted to the top surface of each said flat portion.

3. A system of protective coverings as defined in claim 1, wherein said partition bar includes a base elongated wooden stud over which is mounted a plank, said first protecting member surrounding said plank and anchored by anchoring means to said plank and also to said wooden stud.

4. A system of protective coverings as defined in claim 3, wherein said first protecting member defines a hollow elongated member of D-shape in cross-section, with said anchoring means being a number of screws extending through said D-frame, through said plank and through said wooden stud.

5. A system of protective coverings as defined in claim 1, wherein said first and second protecting members are made from a plastic material.

6. A system of protective coverings as defined in claim 1, wherein said second protecting member is a single elongated sheet of flexible, wear-resistant plastic material, applied flatly against said concave gutter, the latter consisting of plywood board.

7. A system of protective coverings as defined in claim 6, further including a retaining strip consisting of a small, flexible, wear-resistant plastic plate having a 180° curved enlarged flange, said plate and flange edgewisely engaging under and over said protecting gutter sheet respectively, said strip retaining said protecting gutter sheet on the side of said runway exclusively of the opposite side thereof, and nailing driven through said plastic plate and into a said gutter, for anchoring said anchoring strip to said gutter.

8. A system of protective coverings as defined in claim 1, wherein said partition bar defines a number of base wooden studs over which is placed a large, flattened pyramidal-shaped, elongated, wooden plank, said first protecting member defining: a slightly bent, H-shaped, semi-rigid plastic module, applied against and conforming to the shape of the top apex area of said pyramidal plank, said H-shaped module defining two opposite channels between the legs of its H, and two substantially flat sheets of semi-rigid plastic material, each one of said sheets having an inner offset edgewise section, for engagement into a corresponding one of said channels of the H-shaped module, and an outer transverse edgewise flange making a small obtuse angle with the corresponding said flat sheet of the protecting member so as to follow the contour of said pyramidal plank, each said flange having a right-angle inturned lip extending between the edgewise section of said pyramidal plank and the outermost base wooden stud; further including a number of screws, vertically driven through said sheets, said pyramidal plank, and said outermost studs, wherein said sheets are frictionally releasably edgewisely interlocked through said H-shaped module.

9. In combination, a bowling alley of conventional make having at least one elongated runway, at least one downwardly offset concave gutter sidewisely depending from said runway, and at least one upwardly offset partition bar sidewisely depending from the side edge of said gutter opposite said runway, a first wear-resistant semi-rigid protecting member for removably covering the upper portion of said partition bar, and a second wear-resistant flexible protecting member for removably covering the top face of said gutter; wherein each of said first and second protecting members further has guide means whereby should the ball inadvertently engage said gutter or said bar, said guide means will bias the bowling ball to travel in a path parallel to said elongated runway, said guide means furthermore prolonging the useful lifetime of said bowling alley.

* * * * *